US005190155A

United States Patent [19]

Grunwald

[11] Patent Number: 5,190,155

[45] Date of Patent: Mar. 2, 1993

[54] TAMPER PROOF FOLDING BOX

[75] Inventor: Herbert Grunwald, Gutach, Fed. Rep. of Germany

[73] Assignee: August Faller KG, Waldkirch, Fed. Rep. of Germany

[21] Appl. No.: 642,229

[22] Filed: Jan. 16, 1991

Related U.S. Application Data

[63] Continuation of Ser. No. 434,401, Nov. 9, 1989, abandoned, which is a continuation of Ser. No. 159,544, Feb. 23, 1988, abandoned.

[51] Int. Cl.[5] ..... B65D 77/30

[52] U.S. Cl. ..... 206/459.1; 229/232; 229/233

[58] Field of Search ..... 229/102, 152, 211, 224, 229/228, 231, 232, 233, 234; 206/634, 624, 626, 459, 807, 459.1, 459.5

[56] References Cited

U.S. PATENT DOCUMENTS

| | | | |
|---|---|---|---|
| 636,806 | 11/1899 | Johnstone . | |
| 2,249,244 | 7/1941 | Guyer | 229/152 |
| 3,191,848 | 6/1965 | Meyers . | |
| 3,233,818 | 2/1966 | Bixler et al. | 229/102 |
| 3,662,945 | 5/1972 | Foster et al. | 206/625 |
| 3,784,087 | 1/1974 | Styers | 229/62 |
| 3,893,614 | 7/1975 | Myers | 229/51 |
| 4,150,748 | 4/1979 | Mueller | 206/624 |
| 4,266,671 | 5/1981 | Roccaforte | 206/626 |
| 4,344,533 | 8/1982 | Olsen | 206/459 |
| 4,434,896 | 3/1984 | Beloate et al. | 206/621 |
| 4,508,226 | 4/1985 | Davis et al. | 206/620 |
| 4,573,634 | 3/1986 | Kohler et al. | 229/38 |
| 4,614,297 | 9/1986 | Davis et al. | 229/132 |

FOREIGN PATENT DOCUMENTS

| | | | |
|---|---|---|---|
| 3340798 | 3/1984 | Fed. Rep. of Germany | 229/152 |
| 2504892 | 4/1981 | France . | |
| 2024162 | 1/1980 | United Kingdom | 229/102 |

*Primary Examiner*—Jimmy G. Foster
*Attorney, Agent, or Firm*—Wolf, Greenfield & Sacks

[57] ABSTRACT

A folding box has a reclosable end flap opening on a side wall panel end which defines a seal identifying segment portion. The reclosable end flap covers the reclosable opening and has a bent over flap extension adjacent to the seal identifying segment. The box permits hand separation of the segment to break the seal of the box while allowing the reclosable flap to act as a reclosable portion after the seal is broken so that there is a visible indication that the seal is no longer intact.

5 Claims, 1 Drawing Sheet

TAMPER PROOF FOLDING BOX

RELATED APPLICATIONS

This application is a continuation of application Ser. No. 07/434,401 filed Nov. 9, 1989, now abandoned, which is a continuation of application Ser. No. 07/159,544 filed Feb. 23, 1988, now abandoned.

BACKGROUND OF THE INVENTION

Folded cartons or boxes are often used with a number of products which come into contact with the hands of the consumer. Particularly in pharmaceutical products, it is important to know whether or not the boxes have been opened at any time prior to sale or certain uses.

Often the prior art has turned to the use of attaching supplemental labels over fold lines and opening lines of cartons. If the labels are broken, one assumes the carton has been opened by a curious consumer or other. It is sometimes difficult or inconvenient to use labels in connection with the tucked-in end of folding cartons to determine whether or not they have been opened. Sometimes packaging machines are slowed down in their operation by the use of such labels or other complications arise. Often changes in overall manufacture may be required when supplementary labels are used.

SUMMARY OF THE INVENTION

It is an object of this invention to provide a reclosable box having a seal which can be identified as intact or not and which permits ease of reclosure after the seal has been broken.

Still another object of this invention is to provide a novel and advantageous folding box in accordance with the preceding object wherein box blanks can be formed in a conventional manner and assembled rapidly and efficiently in manufacturing procedures.

Still another object of this invention is to provide a box in accordance with the preceding objects which can be formed of paper or cardboard in a highly efficient manner with ease of production and assurance of seal integrity identification in use.

According to the invention, a reclosable box such as a folding box or carton having a seal comprises an encircling side panel means defining an upper edge forming a reclosable opening to the box. The side panel means defines a seal identifying segment portion defined therein and located adjacent the upper edge. A reclosable end flap covers the reclosable opening having a bent-over flap extension adjacent the seal identifying segment. Means permit hand separation of the segment from the side panel means whereby the end flap acts as a closure for the box and the means permitting hand separation allows an observer to identify that the segment has been separated. The bent over flap extension preferably has a width greater than the width of the segment portion width. The flap extension is unattached to a side panel adjacent to the segment and is unweakened in an area where weakening lines are in said one side panel.

Preferably the box is a cardboard box and the segment is attached to a supplementary flap extending therefrom which is severed along with said segment and attached to said reclosable end flap to aid in closure. In the preferred embodiment the box is generally rectangular with four planar side walls meeting at right angles having a conventional bent-over bottom and top flap, all of which can be sealed at adjacent portions of the planar surfaces by conventional hot-melt adhesives, gluing, or adhesively united with the use of ultrasonic energy.

It is a feature of this invention that a folding box or carton can be kept constantly closed and any unauthorized first opening of the folding carton can be visually identified immediately. After the initial opening and breaking of the seal, the box is easy to close again and to reuse even though the original seal is broken. The eye of an observer can quickly identify the original seal separation; yet, the contents are fully protected and maintained within the box by a reclosable end flap which covers a reclosable opening and carries a bent-over flap extension adjacent to the segment. The bent-over flap extension is the tuck-in end of a flap as generally known in the folding carton industry.

BRIEF DESCRIPTION OF THE DRAWINGS

The above and other objects, features and advantages of the present invention will be better understood from a reading of the specification in which.

DESCRIPTION OF THE PREFERRED EMBODIMENTS

Figure 1:
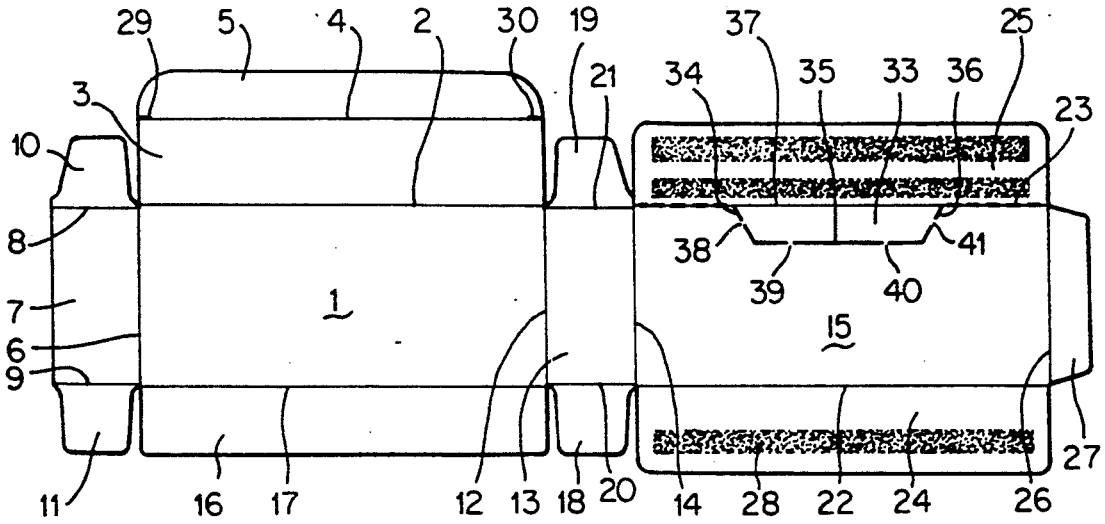
FIG. 1 is a plan view of a box blank in accordance with a preferred embodiment of the present invention.
Figure 2:
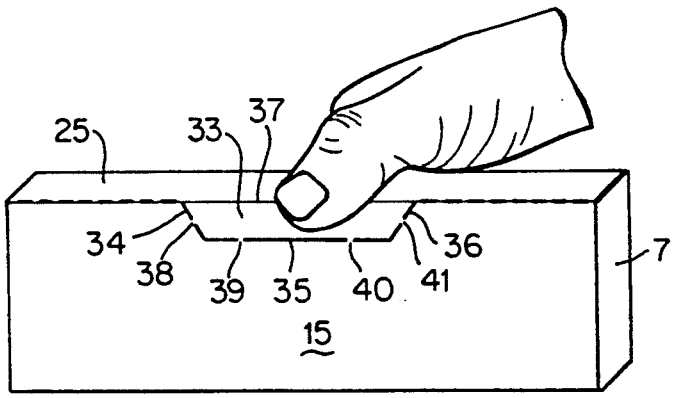
FIG. 2 is an assembled form of the box showing the hand of the user located on the box to permit hand opening of the box by pressure of the thumb.

The folding carton or box as shown in FIG. 1 in the form of a blank, defines an encircling side panel means having an upper encircling edge forming a reclosable opening to the box. The upper edge is closed by a reclosable end flap 3 which has a bent-over flap extension 5. A seal identifying segment portion is defined in the side panel means at 33 in FIG. 1 and FIG. 2 in the form of a trapezoidal-shaped segment and lies adjacent the flap extension 5 in the box as shown in FIG. 2. When the extension is broken from the box as by finger pressure acting on a tear line in the box, the end flap 3 can act as a reclosable means and an observer can identify that the segment 33 has been separated.

The box is preferably a folding box having thin planar side walls as known in the art. The side walls can be of paper, plastic, cardboard, ordinary carton material and the like as is well known. Preferably, a thin, less than one quarter inch thick side wall material is used, although this can vary. The side wall material is preferably rigid but yieldable as is known in thin cardboard boxes. In the preferred embodiment, the box is generally rectangular in shape, although square, round or other shapes can by used.

The side panel means of the box of this invention comprises planar thin cardboard side panels or walls 7, 1, 13, 15 and an outwardly extending sealing flap 27 divided by fold lines 6, 12, 14 and 26 respectively. The panels form a rectangular cross section box when the flap 27 is glued or adhered in place behind the side wall 7. This forms the folding box so that it has an encircling edge comprising top edges 8, 2, 21, 37, 23 and parallel bottom edges 9, 17, 20 and 22. Extension flaps 10, 11, 18 and 19 have fold lines 8, 9, 20 and 21 respectively to provide backup flaps. Flaps 11 and 18 may be glued for structural support as is known in the art.

Bottom flaps 16 and 24 are attached at fold lines 17 and 22 for folding under the carton to form a bottom end with flap 16 outermost. Glue lines or adhesive lines for ultrasonic welding as are shown in 28 to provide a sealed lower end of the box.

Planar reclosable end flap 3 extends upward and is separated from the side panel means by fold line 2 and has a fold line 4 from which extends a flap extension 5 to form the tuck-in top as is customary in the art. Conventional cut lines 29 and 30 provide ends for the tuck-in feature.

The upper edge of side wall 15 has a perforated line at 34 which can have solid segments 38, 39, 40, 41 attaching the segment 33 to the side wall so that the segment is actually integral with the side wall although capable of separation by finger pressure. Perforations or slits can be used and the like. A top flap 25 extends upwardly from side wall 15 at a fold line 23. The fold line 23 has a central portion 37 where the flap is attached to the segment 33.

In use, flap 3 can be bent to have its extension 5 extend rearwardly and be positioned directly behind the segment 33 when the segment 33 is in the position shown in FIG. 2. Fold lines 23, 37 can be perforated to allow breakage by finger pressure. In some cases, only portion 23 is perforated while in other cases if desired, the entire section 23–37 is perforated. It is also possible to perforate and separate only along line 38 and if desired line 23. Note that fold lines 23 and 37 are parallel to the opposite edge 2 of the carton. In final position, it is preferred that the flap 25 be the outside of the carton with underlining adhesive means attaching it to the top of flap 3.

Figure 3:
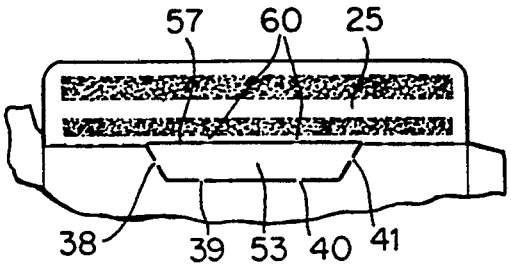
FIG. 3 is a detail of a second embodiment of a feature of the invention.

FIG. 3 shows slits with integral portions 60 connecting the segment 53 to the top flap 25. In this embodiment, the segment 53 is separable from the top flap 25 whereas in FIG. 1, line 37 can merely be a solid fold line. In either embodiment, perforation slits or the like can be used.

The fold lines in the carton can be crease lines in accordance with ordinary folding box techniques. In alternate embodiments of the invention, flap 25 need not be glued to flap 3 but can be glued or otherwise adhered only to flaps 19 and 10 or can be free, although it is preferred to have flap 3 underlie flap 25 and be adhered to flap 25.

Many variations in the folding box construction can be used including variations in materials, dimensions and the like. In the preferred embodiment, the box has dimensions for pharmaceutical purposes and may be of a size to fit in or be handled by a single hand of the user. For example, the box can have a length of 5 inches with a height of 2 inches and a depth of 1 inch.

Generally, to form the carton from the box blank as shown in FIG. I, it is bent into an encircling shape with the sides planar to have a generally rectangular cross section with the flap 27 bent under and adhered to the side 7. The side walls 1 and 15 are parallel to each other as are the end side walls 7 and 12. The flaps 10, 11, 19 and 20 are bent at right angles towards the inside of the box and the flaps 24 and 16 overlapped and adhered. Flap 3 and extension flap 5 are bent at right angles and positioned over flaps 10 and 19 with flap 25 then bent over the top of flap 3 and adhered thereto.

In order to open the sealed carton, finger pressure is applied to the segment 33 to break the line of perforations at least at lines 34, 35 and 36 whereupon line 23 can be broken and flaps 25 and 3 allowing opening of the carton to the position of flap 3 as shown in FIG. 1. The carton is reclosed using extension flap 5. At this point, one can visually see on the outside of the carton that segment 33 has been broken from the side wall means. In addition, if a cutout line 57 is used, the flap 53 resulting can be discarded although this is not required. In either case, it will be obvious to a user that the box has been previously opened once the perforation line is separated. The carton can no longer be made to appear as it was at the time it was originally filled and sealed, yet reclosure is possible.

The original seal can be of any type although in most cases, a seal is not meant to include a hermetic seal but rather a full closure without separation of joined parts.

In summary, the empty carton or box is erected by conventional means with flaps 11, 16, 18, and 28 cooperating to form the floor of the carton and flaps 7, 13 and 27 cooperating to form the ends of the carton. The top of the carton comprises flaps 10, 3, 19 and 25 which can remain open for filling. The carton can be filled, flaps 10 and 19 folded down and subsequently covered by flap 3 with the insertion flap 5 turned over and inserted at that time. Flap 25 is then folded over flap 3 and tenaciously bonded thereto whereupon the filled carton is sealed.

Side panels 15 define the trapezoidal segment 33 which segment is bounded in part by perforated bending lines 23 which extends the full length of side panel 15 and then in part by a perforated line extending from 34 to 36 (or a cut from 34 to 36 bridged by carton material at points 38, 39, 40 and 41). The carton is opened by depressing flap 33 as shown in FIG. 2, and drawing up the cover. This operation has the two fold effect of separating segment 33 from side panel 15 at points 34, 38, 39, 35, 40 and 41 (or along the perforated line so defined) and of separating cover flap 25 from side panel 15 along perforated bending line 23. Segment 33, having been lightly attached to top flap 25, separates all together, thereby permanently and conspicuously altering the carton.

Cover flap 3 which lies immediately below cover flap 25 and remains bonded to it, is also raised when the carton is opened. Thereafter, bonded cover flaps 25 and 3 form the top of the carton, hinged at bending line 2. Insertion flap 5 permanently attached to cover flap 3 along bending line 4 may be reinserted to close the carton in an unsealed condition.

While a specific embodiment of this invention has been shown and described, many variations are possible. While a trapezoidal shape has been shown for segments 33 and 53, the shape can vary greatly. In all cases, it is preferred that a portion be elongated and parallel to a rear edge of the carton to make obvious the fact that the seal has been broken if the segment is removed. However, other shapes such as rectangular, non regular or the like can be used. Similarly, the box can be rectangular, square, round or irregular in cross section and side wall shape. The separation means can be of any known type as can be the means for sealing the cartons. Conventional materials for box and carton construction can also be used in a variety of sizes.

While the carton constructed as described above can be closed and reopened subsequent to initial opening, it cannot be resealed or made to appear sealed as it was at the time of original filing.

I claim:

1. A reclosable folding box having a seal, said box comprising encircling side panels defining an encircling upper edge forming a reclosable opening to said box, one of said side panels having a seal identifying segment portion enclosed therein by perforated lines weakening said one side panel and having a segment portion width and extending from said upper edge, a reclosable end flap covering said reclosable opening having a bent over flap extension having a width greater than said segment width, and underlying said segment portion, said one panel having a second flap extending from said one panel and overlying said first mentioned flap and secured thereto, said flap extension being unweakened in an area underlying said panel weakening lines so as to present a continuous closure at said one panel if said segment portion is removed, said bent over flap extension being unattached to said one side panel adjacent to said segment, said weakening lines acting as separation lines permitting hand separation of said segment portion from said one side panel whereby said end flap acts as a complete closure for said bod and means permitting hand separation allows an observer to identify separation or integrity of said segment portion with said side panel means.

2. A reclosable folding box in accordance with claim 1 wherein said side panels comprise four encircling substantially planar side wall portions defining the upper edge as a rectangular top edge, said top edge having two opposed generally longitudinally extending portions with said reclosable end flap extending from one of said two edge portions and bent over towards said other edge portion and carrying said bent over flap to act as a closure adjacent to is a segment portion and said second flap extending from said other edge portion wherein said segment portion is located at and removably attached to said edge.

3. A reclosable folding box in accordance with claim 2 wherein said box side wall panels comprise paper material and further comprise at least one ultrasonic energy formed seal of at least one flap.

4. A reclosable folding box in accordance with claim 3 wherein said box is generally rectangular in shape.

5. A reclosable closing box in accordance with claim 4 wherein said segment is attached to said side walls by a plurality of spaced paper bridge portions.

* * * * *